United States Patent [19]

Male

[11] Patent Number: 4,771,580

[45] Date of Patent: Sep. 20, 1988

[54] NOZZLE FOR SAND BLASTING

[75] Inventor: Maxwell A. Male, Victoria, Australia

[73] Assignee: Hardblast Australia Pty. Ltd., Victoria, Australia

[21] Appl. No.: 887,404

[22] PCT Filed: Oct. 28, 1985

[86] PCT No.: PCT/AU85/00257

§ 371 Date: Aug. 27, 1986

§ 102(e) Date: Aug. 27, 1986

[87] PCT Pub. No.: WO86/02587

PCT Pub. Date: May 9, 1986

[30] Foreign Application Priority Data

Oct. 29, 1984 [AU] Australia ..... PG7877

[51] Int. Cl.[4] ..... B24C 5/04

[52] U.S. Cl. ..... 51/439; 51/427

[58] Field of Search ..... 51/439, 410, 427, 319–321

[56] References Cited

U.S. PATENT DOCUMENTS

| | | | |
|---|---|---|---|
| 2,114,573 | 4/1938 | Rhodes | 51/321 |
| 2,376,287 | 5/1945 | Sorrentino | 51/439 |
| 2,379,432 | 7/1945 | Heany | 51/439 |
| 2,440,334 | 4/1948 | Gerlach | 51/439 |
| 2,669,809 | 2/1954 | McGrath | 51/321 |
| 2,717,476 | 9/1955 | Myers | 51/439 |

FOREIGN PATENT DOCUMENTS

| | | | |
|---|---|---|---|
| 0934965 | 10/1973 | Canada | 51/439 |
| 0663604 | 12/1951 | United Kingdom | 51/439 |
| 1393560 | 11/1973 | United Kingdom | 51/439 |

*Primary Examiner*—Frederick R. Schmidt
*Assistant Examiner*—Robert A. Rose
*Attorney, Agent, or Firm*—Sughrue, Mion, Zinn, Macpeak and Seas

[57] ABSTRACT

A device for spraying particulate material, comprises a nozzle (10) having an inlet for receiving particulate material under pressure and an outlet for discharging the material, and a housing (8) surrounding at least the outlet portion of the nozzle (10). Passages (30) defined between the housing (8) and the nozzle (10) having inlets to receive a wet fluid under pressure and terminate in an annular outlet zone (50) surrounding the outlet portion of the nozzle (10) whereby the particulate material discharged from the nozzle is surrounded by an annular stream of fluid discharged from the passages. The device may be used for sand blasting, with dry sand being discharged from the nozzle, (10), the sand being enveloped within an annular stream of water discharged from the outlet zone (50) in order to minimize dust formation.

2 Claims, 2 Drawing Sheets

NOZZLE FOR SAND BLASTING

The present invention relates to spraying devices, and more particularly to spraying devices for use in sand blasting.

One problem of sand blasting using dry sand is the production of dust or an aerosol of a solid phase dispersed in a gaseous phase, during the sand blasting operation, which creates a health hazard or problem, such as for example silicosis, amongst the operator or people in the vicinity of the operation. On the other hand, if wet sand is used in the sand blasting operation in order to overcome the dust problem, the efficiency of the operation may be considerably reduced, in some instances by up to 25–40%.

According to the present invention there is provided a device for spraying particulate material, comprising a nozzle having an inlet for receiving particulate material under pressure and an outlet for discharging the material, a housing surrounding at least the outlet portion of the nozzle, passage means defined between the housing and the nozzle, said passage means having an inlet to receive a wet fluid under pressure and said passage means terminating in an annular outlet zone surrounding the outlet portion of the nozzle whereby the particulate material discharged from the nozzle is surrounded by an annular stream of fluid discharged from the passage means.

When the device is used for sand blasting, the sand discharged from the nozzle is surrounded by the stream of wet fluid, the sand and the fluid becoming intermixed when contacting the substrate being blasted.

The wet fluid may be fresh water, salt water, or wet steam.

An embodiment of the invention will now be described by way of example only with reference to the accompanying drawings in which.

Figure 1:
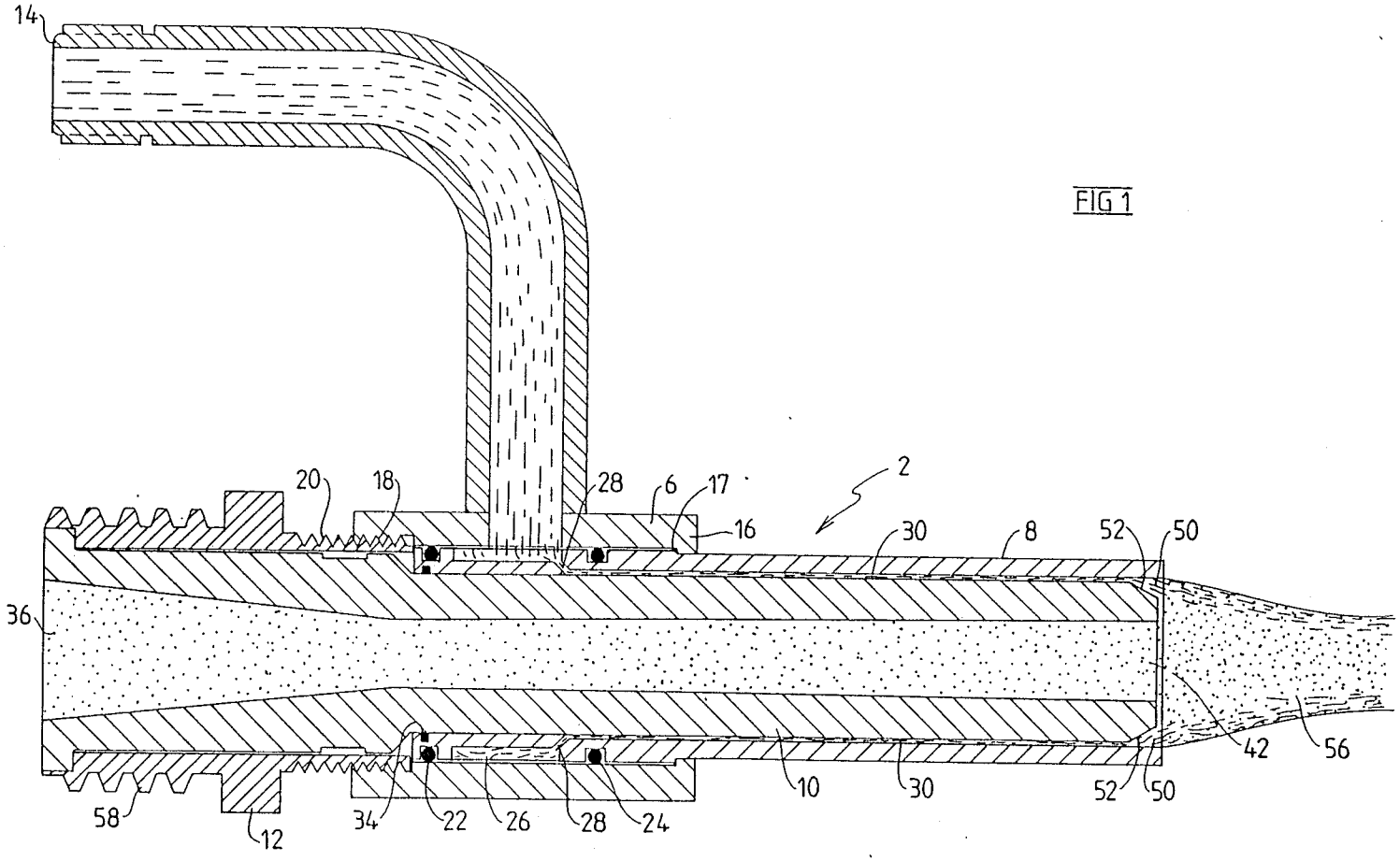
FIG. 1 is a longitudinal section of a preferred embodiment of the spraying device in accordance with the present invention.
Figure 2:
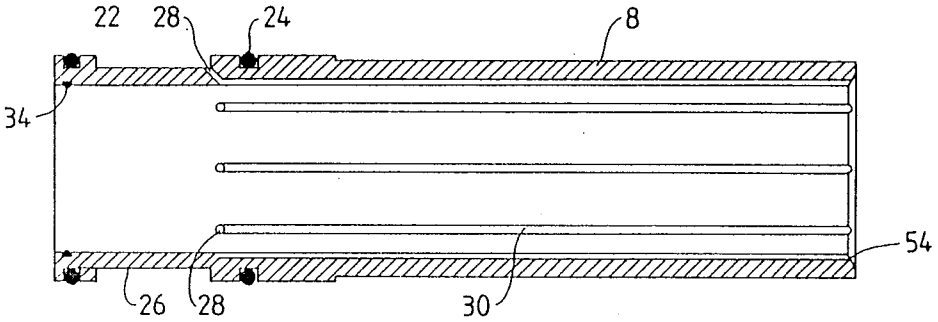
FIG. 2 is a longitudinal section of a housing of the spraying device.

As shown in the drawings, the spraying device generally denoted by 2 comprises an inlet elbow 4 for admitting water or other wet fluid under pressure into the device 2, terminating in a socket 6 for receiving a tubular housing 8 and a sand blasting nozzle 10 which are both secured to the socket 6 by a securing nut 12.

Elbow 4 is connected at an inlet end 14 to a pump (not shown) such as a high pressure water pump capable of delivering water at a pressure of up to 16,000 p.s.i. However, a more typical low pressure range is 25 to 50 p.s.i, while a typical mid-range of pressure is about 250 to 2000 p.s.i. Optionally, the water may contain additives, such as for example, rust inhibitor known by the name "Polyphosphate" in an amount of typically 0.2%. Elbow 4 may take any convenient form as desired. The socket 6, located at the outlet end of elbow 4, is provided at its forwardly facing end with an annular stop ring 16 which abuts against a shoulder 17 on the external surface of the housing 8. At its rearward end, the socket 6 is provided with an internally threaded portion 18 which engages a threaded portion 20 of the securing nut 12, so that the nut 12, when tightened, maintains the housing 8 and nozzle 10 securely in place during operation of the spraying device. Socket 6 is welded to, or integrally made with, elbow 4 in order to withstand the high pressure of water being pumped into the spraying assembly.

Figure 3:
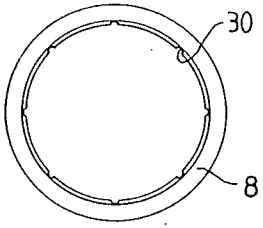
FIG. 3 is an end elevation of the housing.

The housing 8 is, in the form shown, a cylindrical tube having a grooved bore. The outer surface of the tube comprises a first annular groove which receives an "O" ring 22, and a second annular groove which receives an "O" ring 24, the "O" rings serving to seal the housing 8 within the bore of socket 6 so as to prevent leakage of water under pressure. An annular chamber 26 is located intermediate the two annular grooves so as to receive water from elbow 4 and distribute it substantially evenly around the circumference of the housing 8. Ports 28 are equally spaced circumferentially around the annular chamber 26 to permit passage of water from the chamber 26 to internally of the housing 8. Typically, the ports 28 are located at an angle of about 45° to the longitudinal axis of the housing. Longitudinal or other lengthwise extending grooves 30 are circumferentially located in the bore of the housing 8 at spaced apart locations. Grooves 30 extend from ports 28 to the forward end of the housing so that water is discharged from the forward end of the housing after travelling through elbow 4, chamber 26, ports 28 and grooves 30. In the embodiment illustrated each port 28 is in fluid communication with a single groove 30. Typically, the grooves are about 1 mm deep. However, it is to be noted that any suitable pattern of ports 28 and grooves 30, are possible such as helical, spiral, or arrangements where there is more than a single port to each groove, or where each port is in fluid communication with more than a single groove. A typical arrangement of grooves 30 is shown in FIG. 3. There may be any number of grooves or ports such as from 4 up to 16, and the grooves may be shallower or deeper than 1 mm.

An annular groove is located circumferentially within the bore of housing 8 at its inner end for receiving an "O" 34 ring for sealing the housing 8 to nozzle 10 to prevent any water under pressure leaking back from the grooves 30 between the nozzle and housing.

The water used in the device may be fresh water or salt water (whichever is the more readily available) or alternatively other wet fluids may be used, for example, wet steam.

Nozzle 10 is derived from a conventional nozzle having a tungsten carbide internal insert and comprises an inlet 36 for admitting sand under pressure. Although reference is being made herein to the use of sand, it is to be understood that other suitable blasting or abrasive materials may be used. Typical blasting materials are conventional blasting aggregates comprising washed clean sand that has been dried and sieved to size. A typical air supply for propelling the material through the nozzle would be from 360 to 500 c.f.m. at a combined pressure of 50 to 300 p.s.i. typically 150 to 200 p.s.i.

Bore 38 which extends lengthwise through the centre of the nozzle is tapered from a relatively larger diameter at its rearward end to a relatively smaller diameter about $\frac{1}{3}$ to $\frac{1}{4}$ upstream from the rearward end and from that point gradually increases in diameter towards the forward end which forms an outlet 42 for the sand being sprayed. At the forward end of the nozzle 10, the external surface of the nozzle is tapered or otherwise shaped to define with the internal surface of the housing 8 an annular outlet zone 50 of divergent longitudinal section and into which the grooves 30 discharge. In the embodiment shown, the taper is defined by a frusto-conical surface 52 having a cone angle of about 45° which has been found to provide effective operation, although it is to be understood that other angles may be used. In operation, the sand fed through the nozzle 10 is discharged from the nozzle outlet 42 as a high velocity stream, typically at a velocity of the order of 400 ft/sec, and creates a vortex within the divergent outlet zone 50 which tends to draw water around the edge of the stream and to atomise the water. It will be noted from FIG. 1 that the forward end of the nozzle 10 is axially inwardly offset with respect to the end of the housing 8, so that the housing 8 extends beyond the nozzle 10. This extension facilitates intermixing of the atomised water and sand at the edge of the stream of sand. The degree of extension may be variable, but the greater the extension, the greater will be the degree of intermixing. The extension may be up to 1 inch.

At the forward end of the housing 8, the inner surface may be chamfered or rounded as shown at 54 to improve the spray pattern. A typical spray pattern is shown at 56 in FIG. 1.

Typically, the gap between the inner wall of housing 8 and the outer wall of nozzle 10 is about 0.006 inch in the region where there is no lengthwise extending groove 30. The internal bore of nozzle 10 may be obtained in a variety of sizes from say about 8–10 mm up to $\frac{5}{8}$" with the same external size to be received with a single size jacket 8. However, larger size nozzles may be accommodated within larger sized jackets 8. Securing nut 12 is provided with an externally threaded portion 58 for connection to a supply of solid particulate material in a conventional manner.

In operation, the atomised water acts as an envelope or curtain surrounding the sand so as to contain the sand in the desired spray pattern before the sand contacts the substrate. In this manner, the sand remains dry and hence is similar in action to that in conventional dry sand blasting. Immediately after contacting the substrate, the dry sand is mixed with water as the spray pattern is destroyed to produce wet sand which reduces the problems which would otherwise result from dust formation.

The productivity and efficiency of the blast produced is substantially the same as that of dry sand blasting since the sand which hits the substrate is in essence dry sand, but without the production of substantial amounts of dust.

Although the embodiment has been specifically described in relation to spray devices for use in sand blasting, the invention is not limited to this particular use.

Those skilled in the art will appreciate that the invention described herein is susceptible to variations and modifications other than those specifically described.

I claim:

1. A device for spraying particulate material, comprising a nozzle having an inlet for receiving particulate material and an outlet for discharging the material, a housing surrounding at least the outlet portion of the nozzle, said housing having a cylindrical inner surface in close proximity to the outer surface of the nozzle, and said housing having an outer end closely adjacent the outlet of the nozzle, said cylindrical inner surface having a plurality of grooves formed in and extending along the cylindrical inner surface of said housing, said grooves each being of constant cross-sectional shape and angularly spaced apart around the longitudinal axis of the cylindrical inner surface of said housing with each of said grooves having an inlet end comprising an angled port remote from the outlet of the nozzle and an outlet end closely adjacent to the outlet of the nozzle, means defining an annular water chamber communicating with parts to feed water under pressure into the grooves, said grooves defining with the outer surface of the nozzle a plurality of circumferentially spaced apart passages along which the water passes to be discharged in an unconfined stream which encloses and mixes with the outer layer of particulate matter discharged from the nozzle.

2. A device according to claim 1, further comprising a socket, said housing having an inner end portion remote from the outer end, said inner end portion being within the socket, and screw means threadedly connected with the socket and releasably mounting the nozzle and the housing to the socket, said chamber being annular and being defined between the socket and the housing.

* * * * *